United States Patent [19]

Matsuura

[11] 4,207,443

[45] Jun. 10, 1980

[54] KEY-OPERATED SWITCH AND AN ASSEMBLAGE OF SUCH SWITCHES FOR ELECTRONIC DESK CALCULATORS OR THE LIKE

[75] Inventor: Yasuo Matsuura, Tokyo, Japan

[73] Assignee: Mikado Precision Industries Ltd., Tokyo, Japan

[21] Appl. No.: 932,326

[22] Filed: Aug. 9, 1978

[30] Foreign Application Priority Data

Mar. 17, 1978 [JP] Japan ..... 53-29876

[51] Int. Cl.[2] ..... H01H 13/70

[52] U.S. Cl. ..... 200/5 A; 200/159 B

[58] Field of Search ..... 200/86 R, 5 A, 159 B, 200/308, 340

[56] References Cited

U.S. PATENT DOCUMENTS

| | | | |
|---|---|---|---|
| 3,591,749 | 7/1971 | Comstock | 200/308 |
| 3,617,660 | 11/1971 | Krakinowski | 200/86 R X |
| 3,665,126 | 5/1972 | Gabor | 200/5 A |
| 3,699,294 | 10/1972 | Sudduth | 200/86 R X |
| 3,860,771 | 1/1975 | Lynn et al. | 200/5 A |
| 3,898,421 | 8/1975 | Suzumura | 200/5 A X |
| 3,996,429 | 12/1976 | Chu et al. | 200/5 A |
| 4,032,729 | 6/1977 | Koistinen | 200/5 A |
| 4,046,975 | 9/1977 | Seeger, Jr. | 200/5 A |
| 4,046,981 | 9/1977 | Johnson et al. | 200/5 A X |
| 4,066,851 | 1/1978 | White et al. | 200/86 R X |
| 4,125,934 | 11/1978 | Keough et al. | 200/5 A X |
| 4,143,253 | 3/1979 | Wagner et al. | 200/5 A |
| 4,154,178 | 5/1979 | Brown et al. | 200/5 A X |

OTHER PUBLICATIONS

R. H. Harris et al.; IBM Tech. Disc. Bull., "Force Concentrator For Touch Sensitive Panel Using Snap-Action Switches, " vol. 19; No. 1, Jun. 6, 1976; p. 238.

*Primary Examiner*—James R. Scott

*Attorney, Agent, or Firm*—Hill, Van Santen, Steadman, Chiara & Simpson

[57] ABSTRACT

An assemblage of hand-operated switches includes a plurality of printed fixed contact sets on an insulating base. A spacer sheet overlying the insulating base has openings therein in register with the fixed contact sets. Further overlying the spacer sheet is a plastic film having printed movable contacts formed thereon in register with the spacer sheet openings. Each switch is equipped with a key or button, upon depression of which the corresponding movable contact is moved into engagement with the corresponding fixed contact set through the corresponding spacer sheet opening. The plastic film together with the printed movable contacts thereon can be replaced by a single piece of resilient sheet metal.

10 Claims, 9 Drawing Figures

KEY-OPERATED SWITCH AND AN ASSEMBLAGE OF SUCH SWITCHES FOR ELECTRONIC DESK CALCULATORS OR THE LIKE

BACKGROUND OF THE INVENTION

1. Field of the Invention

This invention relates to electrical switches and, in particular, to a key-operated or push-button switch of reduced thickness or height. Still more particularly, the invention deals with an assemblage of such switches well adapted for use with the input keyboard of an electronic desk calculator.

2. Description of the Prior Art

The advent of large-scale integrated (LSI) circuits has led to the miniaturization of electronic desk calculators and numerous other electronic instruments. LSI circuits have even found their way into clocks, watches and like devices that have been built of purely mechanical means. With the application of LSI circuits to many such instruments, a need has arisen to reduce the size of hand-operated switches accompanying the LSI circuits.

Regarding electronic desk calculators, for example, the current trend is toward the minimization of their thickness. This objective is tantamount to the minimization of the thickness or height of the switches under the keyboards of the calculators. Prior art switches used in desk calculators (FIGS. 1 through 3 of the accompanying drawings) have been such, however, that their thickness has been approximately four millimeters at a minimum. The prior art switches are also objectionable in view of difficulties involved in their manufacture or assemblage and of their comparatively short service life.

SUMMARY OF THE INVENTION

It is an object of this invention to provide a key-operated or push-button switch which is practically minimized in thickness or height, durable, and easy and economical to manufacture.

It is also an object of this invention to provide an assemblage of such hand-operated switches well adapted for use in electronic desk calculators, among other electronic instruments.

Briefly, the hand-operated switch according to the invention comprises at least one printed fixed contact on an insulating surface, and a resilient, substantially sheet-like movable contact overlying the insulating surface via spacer means. A key or button overlying the movable contact is adapted to be manually depressed to move the movable contact into engagement with the fixed contact via the spacer means.

A desired number of such switches are arranged in rows and columns for use in an electronic desk calculator. Preferably, in this case, the spacer means takes the form of a thin sheet or film of plastic material having openings formed therein in register with the printed fixed contact sets on an insulating base. Over the spacer sheet or film another plastic film is provided which has formed thereon printed movable contacts arranged in register with the spacer sheet openings. Upon depression of any of a set of buttons or keys over the plastic film, the latter deflects to move the corresponding movable contact thereon into engagement with the corresponding fixed contact set through the corresponding spacer sheet opening.

Preferably, the plastic film carrying the printed movable contacts is fabricated from polyimide resin or the like so that the film may possess suitable resiliency and high durability. Although the durability of the plastic film itself is of course desirable, it should also be appreciated that this plastic film needs to be deflected only very slightly to move any movable contact thereon into proper engagement with the corresponding fixed contact set. This is because only the thin spacer sheet is employed to normally hold the movable contacts electrically disconnected from the fixed contact sets. The plastic film is thus prevented from any rapid aging. It is therefore possible to extend significantly the useful life of the switches and of the calculator itself.

The switch array of the foregoing construction has the additional advantage that the printed movable contacts on the plastic film can be easily interconnected electrically. This advantage is possible because the movable contacts can be formed simultaneously with printed interconnections therebetween. It is also noteworthy that the total thickness of the switch array does not increase to any extent if the movable contacts are interconnected as stated above.

Because of the foregoing advantages the switch array according to the invention is of particular utility when applied to an electronic desk calculator incorporating a buzzer circuit separate from its main processing circuit. The buzzer circuit is intended to produce an audible sound each time one of the calculator keys is depressed. The movable contacts of the switches, interconnected as above, can be easily jointly connected to the buzzer circuit, in order that upon depression of any calculator key, a suitable buzzer signal may be delivered from the main processing circuit to the buzzer circuit via the closed switch. The incorporation of a separate buzzer circuit in a desk calculator is preferred to the reconstruction of its main processing circuit, which is in the form of an LSI circuit. The former alternative is far more economical.

The above and other objects, features and advantages of this invention and the manner of attaining them will become more readily apparent, and the invention itself will best be understood, from the following detailed description, which is to be read in connection with the accompanying drawings.

DETAILED DESCRIPTION

Figure 1:
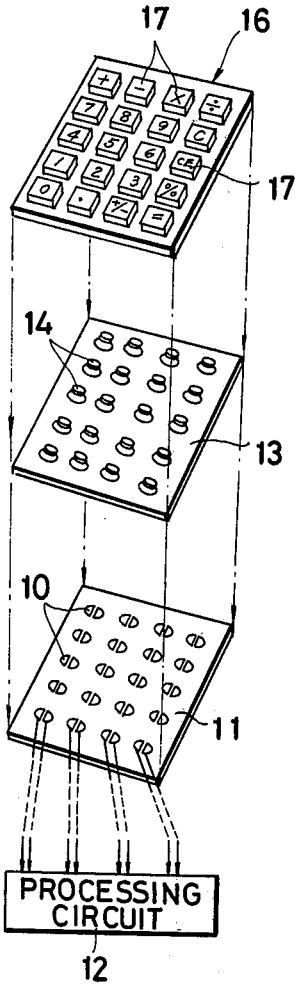
FIG. 1 PRIOR ART
FIG. 1 is an exploded perspective view of the keyboard and associated switches of a typical prior art electronic desk calculator.

It will redound to the full appreciation of the features and advantages of this invention to show and describe, in some more detail, some typical prior art key-operated switches. FIG. 1 is an illustration of one such prior art type of key-operated switches arrayed for use in an electronic desk calculator. The switch array includes pairs of printed fixed contacts 10 formed on an insulating base 11. All these fixed contact pairs are individually electrically connected to an electronic processing circuit 12 which takes the form of an LSI circuit.

Figure 2:
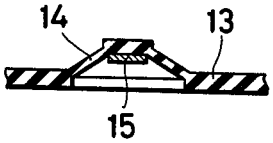
FIG. 2 PRIOR ART
FIG. 2 is an enlarged sectional view of one of the movable contacts and its frustoconical support portion in the prior art keyboard switches of FIG. 1.

Overlying the insulating base 11 is a sheet 13 of rubber or rubber-like material which is formed to include support portions 14 of frustoconical shape. As shown on an enlarged scale in FIG. 2, each support portion 14 carries a movable contact 15 on its underside. Each movable contact 15 is disposed opposite to one of the fixed contact pairs 10 on the insulating base 11.

A keyboard 16 lies further over the rubber sheet 13. This keyboard has an array of keys or buttons 17 disposed in register with the support portions 14 of the rubber sheet. Each time one of the buttons 17 is depressed, therefore, the frustoconical support portion 14 of the rubber sheet 13 under the depressed button collapses, thereby bringing the movable contact 15 thereunder into engagement with the corresponding one of the fixed contact pairs 10 on the insulating base 11.

An objection to this prior art switch construction is that the thickness of the desk calculator cannot be reduced to an absolute minimum because of the frustoconical support portions 14 of the rubber sheet 13. The rubber support portions are also objectionable in view of their rapid aging. The useful life of the desk calculators incorporating such prior art switches has actually not been as long as desired.

A further objection to the above prior art switches concerns difficulties encountered in their assemblage. The difficulties arise also from the frustoconical support portions, to which the movable contacts of the switches must be attached individually. As a consequence, the switches are very likely to give rise to trouble in the use of the desk calculator.

Figure 3:
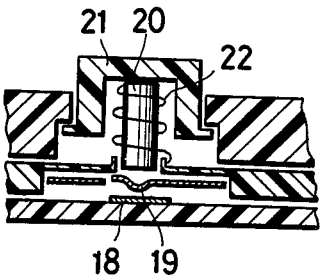
FIG. 3 PRIOR ART
FIG. 3 is a sectional view of one of the keyboard switches of another example of prior art desk calculator.

In FIG. 3 is shown another example of prior art key-operated switches, which comprises a printed fixed contact 18 and a movable contact 19 in the form of a leaf spring overhanging the fixed contact. A switch actuator pin 20 is disposed between the movable contact 19 and a button 21. A helical compression spring 22, loosely wound around the actuator pin 20, biases same away from the movable contact 19. Upon depression of the button 21, therefore, the actuator pin 20 is moved against the bias of the compression spring 22 thereby bringing the movable contact 19 into engagement with the fixed contact 18.

Desk calculators incorporating this second prior art type of switches also cannot be minimized in thickness, mainly because of the presence of the actuator pins 20 and compression springs 22. For the same reason these switches are also difficult of assemblage.

EMBODIMENTS OF THE INVENTION

Figure 4:
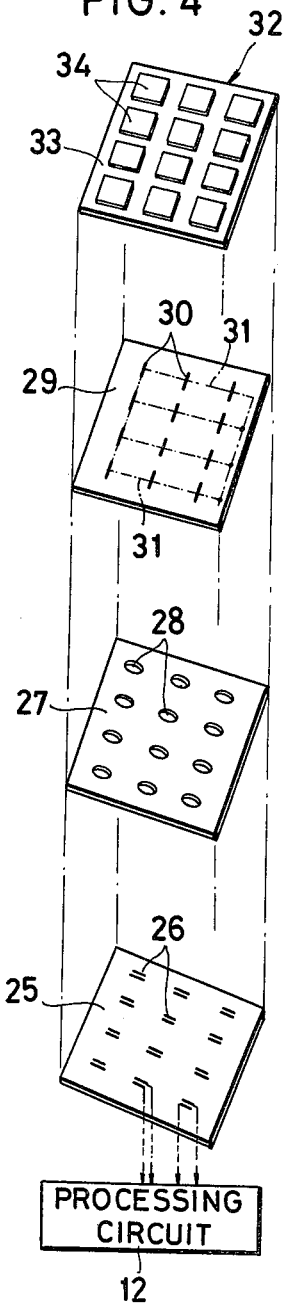
FIG. 4 is an exploded perspective view of an assemblage of key-operated switches according to this invention as adapted for an electronic desk calculator.
Figure 5:
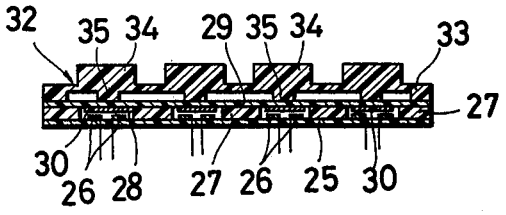
FIG. 5 is an enlarged sectional view of the keyboard switches of FIG. 4.

All the above noted problems of the prior art are thoroughly overcome by the present invention, which is described hereinbelow in terms of several preferred embodiments thereof. FIGS. 4 and 5 illustrate one such embodiment wherein a plurality of key-operated switches in accordance with the invention are assembled in an array for use in an electronic desk calculator.

The key-operated switch array includes an insulating base 25 of any suitable material. A plurality of pairs of printed fixed contacts 26 are formed in rows and columns on the insulating base 25. All the fixed contact pairs 26 are individually electrically connected to the usual electronic processing circuit 12 of the desk calculator, the processing circuit being in the form of an LSI circuit as aforesaid. Preferably, the fixed contacts 26 are in the form of short, narrow strips arranged parallel to each other with a spacing of, for example, 0.2 millimeter therebetween.

Over the insulating base 25 there is provided a spacer sheet 27 which has a plurality of holes or openings 28 formed therein. These openings 28 in the spacer sheet are disposed in register with the fixed contact pairs 26 on the insulating base 25. In one form of construction the spacer sheet 27 is made of "Mylar" (trademark for polyester films manufactured by E. I. du Pont de Nemours & Co.) with a thickness of not more than about 0.2 millimeter.

Although the openings 28 in the spacer sheet 27 are shown to be circular in shape, this is by way of example only. In practice the shape and size of the spacer sheet openings may be suitably determined in consideration of such factors as the thickness of the spacer sheet, the intended application of the switches, and the expected actuating pressures to be exerted on the switches.

A film or sheet 29 of resilient material lies further over the spacer sheet 27. In this particular embodiment the resilient film 29 is of plastic material, preferably polyimide resin, and has a thickness of several tens (e.g. 3 to 6) of micrometers which is on the order of between 1 and 3 mils. The plastic film 29 has a plurality of printed movable contacts 30 formed on its face placed opposite to the spacer sheet 27. These movable contacts 30 are disposed in register with the spacer sheet openings 28 and are normally held electrically disconnected from the fixed contact pairs 26 by the spacer sheet 27.

Each movable contact 30 is also shown to be in the form of a short, narrow strip, with a width of about 0.1 millimeter. Each movable contact strip 30 extends across the corresponding pair of fixed contact strips 26 for electrically interconnecting same when moved into engagement therewith. Printed conductive lines 31 on the plastic film 29, electrically interconnecting all the movable contacts 30, are described later in connection with FIGS. 6 and 7.

The illustrated forms of the fixed 26 and movable 30 contacts minimize the size of the individual switches. Further, the use of the polyimide resin film 29 as the insulating base of the printed movable contacts 30 is preferred because of its high resiliency. The polyimide resin film also contributes to the longer service life of the switches.

Overlying the plastic film 29 is a keyboard 32 including a panel 33 of soft plastic molded integral with an array of keys or buttons 34 projecting upwardly therefrom. These buttons are disposed in register with the movable contacts 30 on the plastic film 29. Preferably, the keyboard panel 33 is further molded integral with bosses 35 projecting downwardly therefrom for abutting contact with the plastic film 29 and disposed in register with the buttons 34.

With the use of soft plastic such as flexible expanded or foamed vinyl as the material of the keyboard 32, the movable contacts 30 can be moved into positive engagement with the fixed contact pairs 26 with the exertion of a minimum actuating pressure on the buttons 34. Such positive closure of the switches can be further assured by the provision of the bosses 35 under the keyboard panel 33.

In the use of an electronic desk calculator incorporating the switch array in accordance with this invention, the keys or buttons 34 of the keyboard 32 are to be individually depressed to close the corresponding switches. The depression of each button 34 results in the deflection of the keyboard panel 33, applying a downward pressure to the plastic film 29 via one of the bosses 35. The plastic film 29 also deflects and thus moves one of the movable contacts 30 on its lower face into engagement with the corresponding one of the fixed contact pairs 26 on the insulating base 25 through one of the openings 28 in the spacer sheet 27.

The movable contact 30 moves out of engagement with the fixed contact pair 26 immediately as the button 34 is released from the actuating pressure. This movement is due to the high resiliency of the polyimide resin film 29 forming the insulating base of the printed movable contacts 30.

The switch array of the foregoing construction is characterized by its extreme thinness, aside from its durability. The thinness of this switch array is realized mainly by the spacer sheet 27 and plastic film 29 which in combination replace, for example, the frustoconical support portions 14 in the prior art of FIGS. 1 and 2. The thickness of the switch array according to the invention can be reduced to about two millimeters. This is a great advantage over the prior art, which attained a minimum thickness of only about four millimeters.

Figure 6:
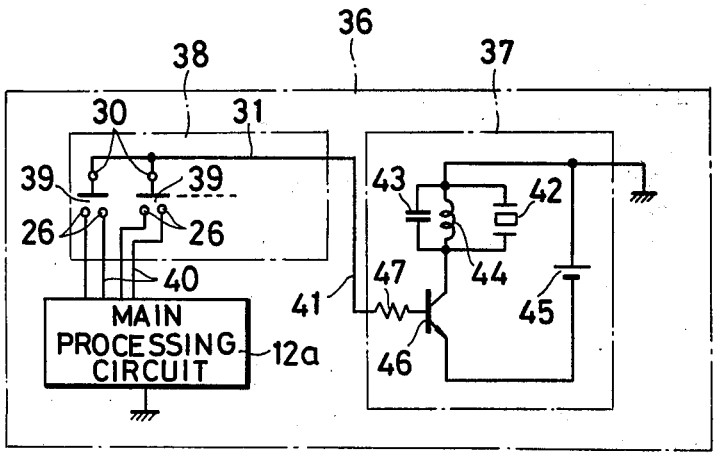
FIG. 6 is a schematic electrical diagram, partly in block form, of a desk calculator incorporating the keyboard switches of FIGS. 4 and 5 in combination with a main processing circuit and a separate buzzer circuit.

FIG. 6 shows the switch array of FIGS. 4 and 5 as adapted for an electronic desk calculator, generally designated 36, of the type having a separate buzzer circuit 37, in addition to a main processing circuit 12*a*. As is well known, the buzzer circuit 37 is intended to produce an audible sound each time one of the calculator buttons is depressed, by way of confirmation of proper switch actuation. The main processing circuit 12*a* comprises a memory, arithmetic unit, control circuit and the like.

The switch array of FIGS. 4 and 5 is generally designated 38 in FIG. 6, and the individual switches are designated 39. The pair of fixed contacts 26 of each switch 39 are individually connected to the input matrix (not shown) of the main processing circuit 12*a* via lines 40. The movable contacts 30 of all the switches 39 are electrically interconnected by the printed lines 31 on the plastic film 29, as previously stated. Thus interconnected, the movable contacts 30 are further connected to the buzzer circuit 37 via a line 41.

The buzzer circuit 37 is of prior art configuration comprising a piezoelectric buzzer 42, capacitor 43, reactor 44, power supply 45, and switching transistor 46, which are connected as shown. The capacitor 43 and reactor 44 form in combination a resonance circuit. The line 41 is connected to the base of the transistor 46 via a resistor 47.

In the operation of the desk calculator 36 of FIG. 6, the proper depression of each button results in the closure of the corresponding one of the switches 39. Upon closure of any one switch the input matrix of the main processing circuit 12*a* produces a corresponding signal to be processed. Simultaneously, the input matrix delivers a buzzer signal of 50 to 300 Hz, for example, to the base of the buzzer circuit transistor 46 via the closed switch thereby causing the buzzer 42 to produce a sound. The operator is thus informed that he has correctly depressed the button.

Figure 7:
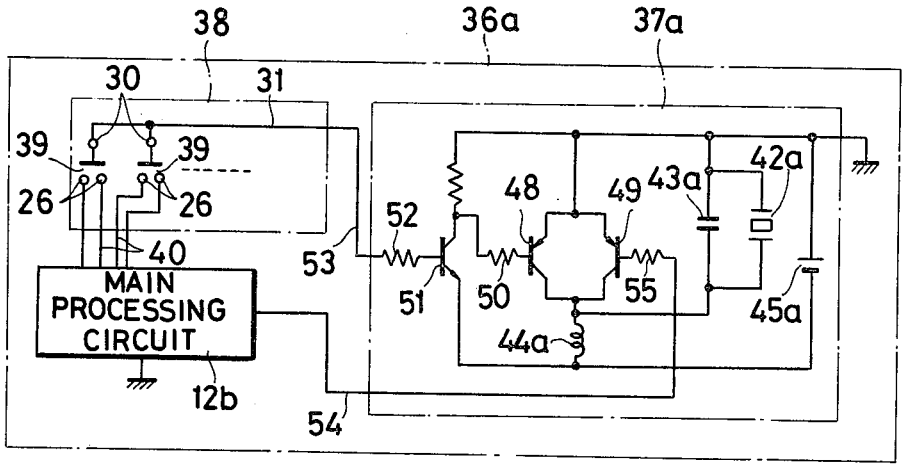
FIG. 7 is a schematic electrical diagram, partly in block form, of another desk calculator incorporating the keyboard switches of FIGS. 4 and 5 in combination with a modified main processing circuit and a modified buzzer circuit.

By way of reference FIG. 7 shows the switch array of FIGS. 4 and 5 as adapted for an electronic desk calculator, generally designated 36*a*, of the type having a separate buzzer circuit 37*a* of modified construction and a clock (not shown). The main processing circuit 12*b* of this calculator-clock combination 36*a* is also modified to deliver an alarm signal to the buzzer circuit 37*a* to cause same to produce an audible sound at a preset time. The modified buzzer circuit 37*a* is further intended to produce a sound each time the calculator buttons are depressed.

The modified buzzer circuit 37*a* is of prior art configuration including a pair of PNP transistors 48 and 49 connected in parallel with each other. The base of the PNP transistor 48 is connected, via resistor 50, NPN transistor 51 and resistor 52, to a line 53 connected to the aforesaid printed lines 31 on the plastic film 29 interconnecting all the movable contacts 30 thereon. The transistor 51 precedes the transistor 48 because the buzzer signal from the main processing circuit 12*b* is of low magnitude.

The base of the other PNP transistor 49 is connected, via a line 54 having a resistor 55, to the main processing circuit 12*b* for receiving the alarm signal therefrom. This alarm signal line 54 is normally maintained at high level. At a preset time the alarm signal of low magnitude, with a frequency of one to three kHz, for example, is delivered from the main processing circuit 12*b* to the transistor 49 via the alarm signal line 54.

Also included in the buzzer circuit 37*a* are a piezoelectric buzzer 42*a*, capacitor 43*a*, reactor 44*a*, and power supply 45*a*, which are connected as shown. The illustrated connections of the buzzer circuit elements are by way of example only. The arrangements of the capacitor 43*a* and reactor 44*a*, in particular, may be altered according to the desired tone of the buzzer sound and other requirements.

In the operation of the calculator-clock combination 36*a* of FIG. 7, the buzzer signal line 53 is maintained at low level, and the alarm signal line 54 at high level, when no calculator button is depressed and when no alarm signal is delivered from the main processing circuit 12*b*. The three transistors 48,49 and 51 of the buzzer circuit 37*a* are therefore normally held nonconductive. Upon closure of any one switch 39 by the depression of the button thereover, the main processing circuit 12*b* delivers the buzzer signal to the base of the NPN transistor 51 via the closed switch thereby causing the buzzer 42*a* to produce a sound. The PNP transistor 49 is then held nonconductive.

In the use of the calculator-clock combination 36*a* as a clock, the alarm signal of low magnitude is delivered from the main processing circuit 12*b* to the base of the PNP transistor 49 at a preset time. The buzzer 42*a* is then also caused to produce a sound. The transistors 48 and 51 are held nonconductive when the alarm signal is delivered to the buzzer circuit 37*a* as stated above.

FIGS. 6 and 7 represent two of the most important applications of the improved switch array according to this invention. Since the switch array has the printed movable contacts 30 on the plastic film 29, the printed conductive lines 31 interconnecting the movable contacts can be formed simultaneously therewith. In other words, the movable contacts of the switches can be interconnected, as for joint connection to the buzzer circuit 37 or 37a, without introducing any additional step in the manufacture of the switch array. The total thickness of the switch array, moreover, is not increased at all by the addition of the printed conductive lines 31.

Figure 8:
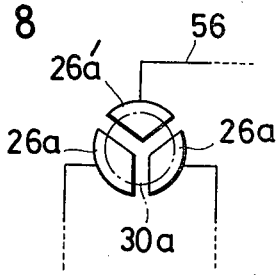
FIG. 8 is a plan view of a fixed contact set in a modified key-operated switch according to the invention.

FIG. 8 shows a modified construction of key-operated switch according to the invention, which is also suitable for use in an electronic desk calculator. The modified switch has three printed fixed contacts 26a and 26a' of sectorial shape disposed radially, and a movable contact 30a of circular shape capable of moving into and out of simultaneous engagement with the three fixed contacts. The movable contact 30a may be printed on a plastic film such as that shown at 29 in FIGS. 4 and 5. Other details of construction can also be identical with those shown in FIGS. 4 and 5.

The two contacts 26a are individually connected to the main processing circuit 12a or 12b of the calculator shown in FIG. 6 or 7. The other fixed contact 26a' is interconnected with the corresponding fixed contacts of other similar switches by printed conductive lines 56 on the insulating base. The thus-interconnected fixed contacts 26a' of the switch array can be easily connected to the buzzer circuit 37 or 37a shown in FIGS. 6 and 7. This modified switch array construction may be employed as an alternative to the construction of FIGS. 4 and 5.

Figure 9:
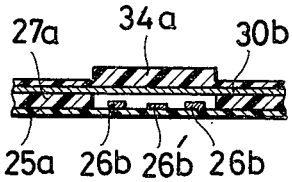
FIG. 9 is a sectional view of another key-operated switch according to the invention.

FIG. 9 shows another modified construction of the key-operated switch array according to the invention, which also is suitable for use in an electronic desk calculator. Each switch of the modified switch array includes three printed fixed contacts 26b and 26b' on an insulating base 25a, and a movable contact 30b in the form of sheet metal. The three fixed contacts 26b and 26b' are shown to be in the form of strips and are arranged side by side. Shared by all the movable contacts of the arrayed switches, the sheet metal 30b is to be moved into engagement with the three fixed contacts 26b and 26b' of each switch upon depression of a button 34a thereon. A spacer sheet 27a is interposed between the insulating base 25a and the sheet metal 30b.

The two fixed contacts 26b, on the opposite sides of the other fixed contact 26b', of each switch are greater in height than the other fixed contact. The technique of selective plating may be employed for thus differentiating the height of the fixed contacts 26b and 26b'. The higher fixed contacts 26b of the switches are individually connected to the main processing circuit 12a or 12b of the calculator shown in FIG. 6 or 7. The lower fixed contacts 26b' of the switches are interconnected by printed conductive lines (not shown) on the insulating base 25a. Thus interconnected, the lower fixed contacts 26b' can be easily connected to the buzzer circuit 37 or 37a shown in FIGS. 6 and 7.

Upon depression of the button 34a, the portion of the sheet metal 30b under the depressed button bulges downwardly. The sheet metal is thus first moved into engagement with the two higher fixed contacts 26b of the switch and then with the lower fixed contact 26b'. Thus, since the fixed contacts 26b are connected to the main processing circuit of the calculator, and the other fixed contact 26b' to its buzzer circuit, the buzzer sounds only when, or after, the fixed contacts 26b are properly closed by the movable contact.

While only certain preferred features of the invention have been shown and described by way of illustration, many modifications will occur to those skilled in the art. For example, in the embodiment of FIG. 9, the sheet metal employed as the movable contacts of the switch array may be replaced by a plastic film having an array of printed movable contacts thereon as in the embodiment of FIGS. 4 and 5. Further, although the present invention has been shown and described as adapted specifically for electronic desk calculators, it will be apparent that the invention is readily adaptable for a great variety of other electronic instruments such as television and radio receivers, electronic watches and clocks. It is, therefore, to be understood that the appended claims are intended to cover all such modifications and adaptations as fall within the true scope of the invention.

What is claimed is:

1. A hand-operated switch for particular use in an electronic instrument comprising:

(a) an insulating surface;

(b) fixed printed contacts on said insulating surface formed as a pair of spaced parallel lines and each adapted to be connected into a circuit of the instrument;

(c) spacer means overlying the insulating surface, and being apertured in registration with said printed contacts;

(d) a resilient plastic film overlying said spacer means;

(e) a movable printed contact on said plastic film formed as a line extending transversely to said spaced parallel lines and engageable therewith; and (f) a button disposed in registration with said movable contact for deflecting said plastic film through said spacer means to effect bridging of said fixed contacts.

2. A switch according to claim 1, said spacer means having a thickness of about 0.2 millimeter (0.008 inch).

3. A switch according to claim 1, said plastic film having a thickness on the order of between 0.0012 to 0.0030 inch.

4. A switch according to claim 3, said plastic film being polyimide resin.

5. A switch according to claim 1, including a connection printed on said plastic film and leading from said movable printed contact and adapted to be connected to the instrument circuit to energize a buzzer circuit.

6. A switch according to claim 1, including a third fixed printed contact formed as a line on said insulating surface, disposed in parallel to said pair of parallel lines, and adapted to be connected to the instrument circuit to energize a buzzer circuit.

7. A switch according to claim 6, said third fixed contact being disposed between said pair of parallel lines, said first-named pair of fixed contacts being disposed closer to said movable contact than said third fixed contact is, whereby the buzzer circuit will be energized only after said pair of fixed contacts has been bridged.

8. In an electronic calculator of the type having a buzzer circuit adapted to produce an audible sound in response to a buzzer signal supplied from a main processing circuit, in combination:

(a) an insulating base;

(b) a plurality of printed fixed contact sets formed in selected positions on said insulating base and individually electrically connected to the main processing circuit, each fixed contact set including at least two fixed contacts formed as a pair of parallel spaced lines;

(c) a spacer sheet overlying said insulating base and having therein a plurality of openings in register with said fixed contact sets on the insulating base;

(d) a plastic film overlying the spacer sheet;

(e) a plurality of printed movable contacts each formed as a line on that surface of the plastic film which is disposed against the spacer sheet, the movable contacts being disposed in registration with and extending transversely to said parallel spaced lines and normally held electrically disconnected therefrom by the spacer sheet;

(f) a printed pattern on the plastic film electrically interconnecting the movable contacts thereon, the interconnected movable contacts being further electrically connected to the buzzer circuit; and (g) a plurality of buttons supported over the plastic film in register with the movable contacts on the plastic film, each button being adapted to be manually depressed to move the corresponding movable contact on the plastic film into engagement with the corresponding fixed contact set on the insulating base through the corresponding opening in the spacer sheet;

(h) whereby the buzzer signal is delivered from the main processing circuit to the buzzer circuit to cause the latter to produce the audible sound each time one of the movable contacts is moved into engagement with the corresponding fixed contact set.

9. In an electronic calculator of the type having a buzzer circuit adapted to produce an audible sound in response to a buzzer signal supplied from a main processing circuit, in combination:

(a) an insulating base;

(b) a plurality of printed fixed contact sets disposed in selected positions on the insulating base, each fixed contact set including three fixed contacts formed as spaced parallel lines, two of which are individually electrically connected to the main processing circuit and the other one of which is electrically connected with the corresponding contacts of the other fixed contact sets, the interconnected contacts of the fixed contact sets being further electrically connected to the buzzer circuit;

(c) a spacer sheet overlying the insulating base and having therein a plurality of openings in register with the fixed contact sets on the insulating base;

(d) a resilient plastic film overlying the spacer sheet;

(e) a plurality of printed movable contacts each formed as a line extending transversely to the lines of one of said fixed contact sets and normally held electrically disconnected from the fixed contact sets on the insulating base by the spacer sheet; and (f) a plurality of buttons supported over the movable contact in register with the fixed contact sets on the insulating base, each button being adapted to be manually depressed to move the movable contact into engagement with the corresponding fixed contact set on the insulating base through the corresponding opening in the spacer sheet;

whereby the buzzer signal is delivered from the main processing circuit to the buzzer circuit to cause the latter to produce the audible sound each time the movable contact is moved into engagement with one of the fixed contact sets.

10. A device according to claim 9, said two of the three fixed contacts being greater in height than, and being disposed on opposite sides of, said other one fixed contact, and said movable contact being adapted to engage said higher two fixed contacts of each fixed contact set before engaging said other one fixed contact thereof in response to the depression of said button thereon, whereby the buzzer circuit is caused to produce the audible sound only when each button is actuated properly.

* * * * *